US008082838B2

(12) United States Patent
Meagher et al.

(10) Patent No.: US 8,082,838 B2
(45) Date of Patent: Dec. 27, 2011

(54) AIR SPRING PNEUMATIC PRODUCT REJECTION SYSTEM

(75) Inventors: Diarmuid Meagher, Sacramento, CA (US); Anthony Bligh, Lucan (IE); Maurice Moynihan, Dublin (IE)

(73) Assignee: Oseney Limited, Dublin (IE)

( * ) Notice: Subject to any disclaimer, the term of this patent is extended or adjusted under 35 U.S.C. 154(b) by 818 days.

(21) Appl. No.: 11/629,039

(22) PCT Filed: Jun. 9, 2005

(86) PCT No.: PCT/IE2005/000066

§ 371 (c)(1),
(2), (4) Date: Jul. 30, 2008

(87) PCT Pub. No.: WO2005/121565

PCT Pub. Date: Dec. 22, 2005

(65) Prior Publication Data

US 2009/0151553 A1 Jun. 18, 2009

(30) Foreign Application Priority Data

Jun. 9, 2004 (EP) ..... 04076688

(51) Int. Cl.
*F15B 15/20* (2006.01)
*B07C 5/36* (2006.01)

(52) U.S. Cl. ..... 92/163; 91/409; 198/370.07

(58) Field of Classification Search ..... 92/162 R, 92/163; 198/370.07; 91/404, 409
See application file for complete search history.

(56) References Cited

U.S. PATENT DOCUMENTS 3,141,381 A * 7/1964 MacDonald ..... 92/24
3,165,981 A * 1/1965 Amour ..... 91/402
3,422,948 A * 1/1969 Burt ..... 198/370.07
(Continued)

FOREIGN PATENT DOCUMENTS

DE 40 38 380 C1 11/1991
(Continued)

OTHER PUBLICATIONS

"Cushion return speeds automation efficiency" Tom Shelley, Eureka, Jul./Aug. 1999, p. 26-27, (2 Pages) GB.

(Continued)

*Primary Examiner* — Thomas E Lazo
(74) *Attorney, Agent, or Firm* — Tarolli, Sundheim, Covell & Tummino LLP

(57) ABSTRACT

A double-acting cylinder and piston mechanism comprising a cylinder (1) substantially closed at both ends by front (5) and rear (7) end walls, a piston (8) axially displaceable within the cylinder (1), a first region (6) defined between the piston (8) and the rear end wall (7) of the cylinder (1) and a second region (4) defined between the piston (8) and the front end wall (5) of the cylinder (1), a piston rod (2) extending from the piston (8) through the front end wall (5) of the cylinder (1), an air inlet port (19) for communication with said first region (6) of the cylinder (1) and at least one exhaust vent (14) which is exposed during axial displacement of the piston (8) for release of air delivered to the cylinder (1) through the air inlet port (19). The double-acting cylinder and piston mechanism is suitable for use in a pneumatic product rejection system, the piston (8) being connected to an ejector finger (18) for displacement of the finger (18) between a clear position and at least one product rejecting disposition of the finger (18).

14 Claims, 3 Drawing Sheets

U.S. PATENT DOCUMENTS 4,099,620 A 7/1978 Kendell et al.
4,595,091 A * 6/1986 Scopatz et al. ..... 198/370.07

FOREIGN PATENT DOCUMENTS

FR 2 479 918 10/1981
FR 2479918 A * 10/1981
GB 990 387 A 4/1966
GB 2 203 195 A 10/1988

OTHER PUBLICATIONS

PCT International Search Report for PCT/IE 2005/000066, dated Sep. 13, 2005.
PCT Written Opinion of the International Searching Authority for PCT/IE2005/000066, dated Sep. 13, 2005.

* cited by examiner

AIR SPRING PNEUMATIC PRODUCT REJECTION SYSTEM

CROSS REFERENCE TO RELATED APPLICATIONS

This application claims priority from and is a National Stage (371) of International Application No. PCT/IE2005/000066, having an international filing date of Jun. 9, 2005, which, in turn, claims priority from European Patent Office Application Serial No. 04076688.3, filed Jun. 9, 2004. This application claims priority from and incorporates by reference both of the aforesaid applications in their respective entireties for all purposes.

FIELD OF THE INVENTION

The invention relates to the field of electronically-controlled sorting machines, in particular to product rejection systems.

BACKGROUND TO THE INVENTION

A modem electronically-controlled sorting machine as used for sorting products in the fruit and vegetable industry has three main elements:

1) a conveyor for presenting the product to the vision system,
2) a vision system which views and inspects the product and makes the necessary decisions to accept or reject product, and
3) a rejection device which kicks out the "rejected" product.

Such arrangements are typically used in processing factories or on harvesting machinery in the field.

Currently, when the vision system identifies an object to be rejected, it sends an electronic signal to the rejector telling it for example "to activate finger no. 34 to reject the tomato which is traveling in its direction at a predetermined period of time".

The rejection device consists of a bank of electro-pneumatic finger/cylinders. There are typically 40-60 fingers (ejectors) across the width of the conveyor, wherein the normal ejector width is 25 mm.

Each ejector comprises an arrangement of pneumatic components connected to a mechanical paddle or solid member. The paddle is activated to achieve product (typically whole fruit and vegetable) ejection from an in-flight product stream.

Typically, the pneumatic components comprise electro-pneumatic valves such as mass-produced 4-way valves and off-the-shelf single-acting or double-acting cylinders. Whilst improvements have been made to the vision system, few improvements have been made to the rejection device. The efficiency of the rejection device is limited by the efficiency of the major proprietary parts of such valves, cylinders etc.

The actuators to which the present invention applies are of compact dimensions, the diameter of the cylinder of the unit being typically less than 25 mm to match the width of the ejector finger or paddle. The overall length of the actuating device is then typically of the order of 150 mm approximately, so that a bank of for example 60 actuators can be readily accommodated in convenient manner in driving association with the fingers, while also being accessible for maintenance and replacement. Because of their relatively compact dimensions, the units of the invention have a relatively small air volume or capacity, while the moving parts are also relatively light in weight, so that inertia effects are minimised and rapid action is facilitated.

Deficiencies of the aforementioned known systems include

1) Inconsistency of response time from mass produced 4-way valves,
2) Cost of "balanced" 4-way valves,
3) Limitations caused by the cycle time with a conventional 4-way valve,
4) Limitations on the forces which can be generated in the cylinder by the conventional 4-way valve,
5) Low ejector speeds,
6) Slow response times, and
7) Damage to rejected product.

DISCUSSION OF PRIOR ART

GB-A-990,387 describes a hydraulic or pneumatic servomotor for operating the clutch or brake of a motor vehicle under the control of a valve which supplies pressure fluid to the right-hand side of a piston for clutch or brake disengagement. The piston itself controls the rate of clutch or brake engagement by sequentially blocking and opening three ports. For clutch or brake disengagement, the valve is moved to the left by mechanical or electromagnetic means. In the case of a clutch, the means may be controlled by a push button on the gearshift lever, actuation of which enables pressure fluid from a pump to move the piston to the left. Return movement of the valve results in rapid movement to the right of the piston under the action of a return spring. When the piston blocks one of the ports, which takes place just prior to clutch or brake engagement, pressure fluid on the right of the piston passes through respective lines and to a restrictor or to vent, thus slowing the piston during initial clutch or brake engagement. The piston subsequently opens a further port to establish unrestricted communication between the two sides of the piston through the foregoing lines, so that the piston may complete its movement rapidly. The restrictor may comprise a valve spool which is normally urged to the left by a spring to provide restricted communication between respective ports. When fluid pressure, which may be a function of engine speed, exceeds a predetermined value, the valve spool moves to the right and reduces the restriction on communication between the foregoing ports. Adjustment of the spring pressure may be effected by a screw.

FR-A-2,479,918 describes a linear actuator having a cylinder within which a moveable piston is mounted for axially sliding movement under the action of a pressure medium. The piston has a portion of greater (larger) cross-section and a portion of lesser (smaller) cross-section. These two piston portions are respectively associated with two distinct chambers defined within the body of the actuator. In one of the end positions of the piston, the piston portion of lesser cross-section passes into the interior of the chamber associated with this lesser cross-section piston portion to an extent such that during the greater part of the displacement of the piston towards its other end position, this piston portion of lesser cross-section remains in sealing sliding contact with the associated chamber. This results in the effect of the fluid medium being limited to act only on the lesser cross-section portion of the piston, thus limiting the force transmitted to the piston rod.

SHELLEY T: "CUSHION RETURN SPEEDS AUTOMATION EFFICIENCY" EUREKA (INC. ENGINEERING MATERIALS AND DESIGN), FINDLAY PUBLICATIONS, HORTON KIRBY, KENT, GB, vol. 19, no. 7, July 1999 (1999-07), pages 26-27, describes an arrangement for reducing energy wastage in a pneumatic cylinder drive. To achieve an improved economic advantage, exhaust air is accumulated during the power stroke and used to drive the return stroke. Working against an air spring also improves the dynamic performance of the system and reduces impact damage and noise. In the arrangement described, the return stroke is powered almost entirely, but not wholly, by air compressed into an accumulator during the power stroke. The system may be tuned by varying the pre-pressure in the accumulator. The dynamic performance of the return stroke may be influenced by exhaust air metering using a variable restrictor. A minimum level of accumulator pre-pressure is favoured, to regulate and reduce accelerations and maximum speeds, and to enable cushioning of the piston at the end of its stroke by counter-acting forces.

U.S. Pat. No. 4,595,091 describes diverter apparatus for rapid and gentle diversion of articles, typically fruit, from a moving conveyor. An ejector lever member and an air cylinder assembly share a common pivot point. Each of the two is pivotable with respect to each other, while also pivoting on pivot pins mounted on a stationary ejector lever mount. The working end of the ejector lever is caused to swing arcuately over a certain distance to divert the fruit when the piston rod of the air cylinder assembly travels over a much shorter distance. Very rapid cycling of the diverter is thus enabled. Diverting and retraction strokes of the piston are controlled using air, by way of a solenoid. The solenoid valve receives control signals from a computer-controlled relay.

GB-A-2,203,195 provides an operating device for a piston running in a double-acting cylinder. The piston rod is in the form of a tool or functional member which may be brought into engagement against a workpiece by being driven by pressure in a chamber. Before the piston rod reaches a position of engagement on the workpiece, a position sensor sends a signal to an electronic controller which causes a valve to close so that the chamber must be drained through a choke, this causing the piston movement to be retarded. A switch detects the position of engagement by the change in pressure in at least one of two cylinder chambers and sends a signal which causes the foregoing valve to be opened again, thereby increasing the thrust on the workpiece, so that welding or a like operation can be performed. After a preset time, the controller returns respective valves to a retraction configuration, whereupon higher pressure produced by a proportional regulating valve relative to a further valve causes the piston to be rapidly retracted until retraction movement is terminated by a suitable sensor. The cycle is then repeated up to a preset number of cycles. Discharge of the chamber may be rapid through two chokes, or slowly through a single choke. The controller may also establish a fluid pressure clamp, to hold the piston rod for a predetermined time in the engagement position.

DE-C-40 38 380 describes an actuator mechanism for use for a press roller in a plastics welding machine. The roller element is moved from an outer work position to a safe spacing from a counter pressing element by means of a drive member such as a coil spring. During this initial movement, connection of pressurising medium to the cylinder space behind the piston is prohibited. Once the safe spacing is achieved, then the full driving force may be applied to the rear of the piston to effect the required pressing operation and thereby enable completion of a welding step. The arrangement provides protection against the risk of injury by differentiating between movement from the initial position to the safe spacing disposition of the roller and the subsequent pressure action associated with the welding step. The latter action only takes place on successful completion of the displacement into the safe spacing location.

OBJECT OF THE INVENTION

It is an object of the invention to provide an improved air spring rejector system with higher ejector speed.

It is also an object of the invention to provide an improved air spring rejector system with improved and consistent response time.

It is a further object of the invention to provide an improved air spring rejector system having improved repeatability.

It is a still further object of the invention to provide an improved air spring rejector system which minimises damage to the reject product.

It is yet another further object of the invention to provide an improved air spring rejector system suitable for use with a large variety of products to be sorted.

SUMMARY OF THE INVENTION

According to the present invention there is provided a double-acting cylinder and piston mechanism comprising:

- a cylinder substantially closed at both ends by front and rear end walls,
- a piston axially displaceable within the cylinder,
- a first region defined between the piston and the rear end wall of the cylinder and a second region defined between the piston and the front end wall of the cylinder,
- a piston rod extending from the piston through the front end wall of the cylinder,
- an air inlet port for communication with said first region of the cylinder, and
- at least one exhaust vent which is exposed during axial displacement of the piston for release of air delivered to the cylinder through the air inlet port. In a favoured arrangement, said release of air takes place directly to ambient.

Preferably a static air pressure is maintained in the second region of the cylinder to cushion impact between the piston and the front end wall of the cylinder. The static air pressure may be preset to a desired level. By controlling the static pressure in the second region of the cylinder, it is possible to control the impact force of the piston and the front end wall of the cylinder.

Axial displacement of the piston may be effected by a change in the differential pressure between the air in the first region and the air in the second region of the cylinder.

The exhaust vent may be suitably defined in the cylinder wall.

In a horizontal disposition of the cylinder, the exhaust vent is desirably located at a circumferential angular location relative to the lowermost longitudinal extent of the cylinder. In a preferred embodiment, the exhaust vent is located at an angle of at least 10°, preferably in the region of 30°, from the vertical, when measured from the lowermost extent of the cylinder (i.e. the "6 o'clock" position). A quantity of lubricating oil may be provided in the cylinder to enhance cylinder lubrication. The preferred location of the exhaust vent ensures that an adequate amount of oil always remains in the cylinder and does not leak out of the exhaust vent.

Desirably, the piston is of sufficient length to prevent communication between the second region and the exhaust vent.

Preferably, the air inlet port is at a first axial end region of the cylinder.

Desirably, the double-acting cylinder and piston mechanism further comprises sealing means between the piston and the cylinder wall.

Preferably, the sealing means comprises at least one piston ring. In a preferred embodiment a pair of piston rings are provided, one in the vicinity of each end region of the piston.

According to a further aspect of the invention there is also provided a pneumatic product rejection system comprising a double-acting cylinder and piston mechanism as defined above.

In a preferred embodiment the pneumatic product rejection system further comprises:

- a high pressure manifold in communication with the air inlet port,
- a low pressure manifold in communication with the second region in the cylinder,
- a control valve between the high pressure manifold and the air inlet port, and
- a paddle mounted at the free end of the piston rod for contacting and displacing from its path a product to be rejected.

Desirably, the paddle, or finger, is pivotally mounted at the free end of the piston rod. The ability to adjust the pressure on the return side of the cylinder (the pressure of the second region of the cylinder), independently of the outward pressure (the pressure in the first region), is advantageous as it allows the paddle impact force to be increased or reduced as required.

According to a third aspect of the invention, there is further provided a pneumatic product rejection system comprising:

- a paddle mounted for displacement between a first product rejecting position and a clear position for the uninhibited passage of product;
- means for displacing the paddle from the clear position towards the first rejecting position; and
- means for selectively curtailing drive movement of the displacing means on completion of a predetermined increment of travel, less than the travel required to displace the paddle from the clear position to the first rejecting position.

A pneumatic product rejection system according to the invention may comprise a double-acting cylinder and piston mechanism as defined above, said means for selectively curtailing drive movement of the displacing means being adapted to control air pressure forward of the piston in the direction of advance of the piston in order to achieve at least one alternative product rejecting position of the paddle located between the first product rejecting and clear positions of the paddle. Control of the pressure in the front end of the cylinder in this way facilitates so-called "targeted rejection", in which in a first rejecting disposition of the finger, reject product is directed to a first reject product collection location, while in a second or alternative rejecting position, product to be discarded or reprocessed is routed to a further reject product retrieval point, for appropriate treatment.

A further option for achieving alternative rejection paths is by use of a two-stage sorting structure, having two successive banks of fingers, one overlying the other at least in part, rejecting action by the fingers of the first bank directing product to the second bank, where it can be routed to one or other of two alternative reject product collection features.

The pneumatic product rejection system may comprise a multiplicity of paddles. The paddles may be aligned with one another, with adjacent paddles capable of being activated in unison to reject a product. Thus the system of the invention is suitable for use with a variety of different sized products.

Each paddle may be connected to its own cylinder and piston arrangement. Furthermore, each cylinder may be provided with air through a single multiported manifold or individual manifolds may be provided for each cylinder.

The air spring rejector system uses a novel pneumatic arrangement of valves and permanently pressurised manifolds combined with a novel cylinder design to achieve higher ejector speeds and better repeatability than conventional systems. Coupled to this is the ability to adjust ejector forces to ensure minimal damage to reject product which needs to be reprocessed. The pressure of the high and low pressure manifolds may be used to adjust the ejector force, for example.

The overall objectives set out and achieved by this invention are as follows:

1. Higher speeds (cycle times)=more accurate sorting.
2. More ejector to ejector repeatability. Nos. 1 to 60 ejectors have the same cycle times +/−2%.
3. Less shock loading of the pneumatic and mechanical system=longer life.
4. Control over the impact force on the rejected product without loss of speed or loss of sort efficiency.
5. Reduced compressed air consumption. Exhaust loss from one port of the cylinder rather than both sides.
6. Cost per ejector channel is reduced by enabling the use of 3/2 way valves rather than the 5/2 valves conventionally used.

The advantages of the present invention include:

1. Multiple cylinders being assisted (i.e. supported or supplied) by a single multiported manifold.
2. Significant cost savings in construction because it does not require expensive balanced 3 way or 4 way valves.
3. Significant improved response time to peak extension (by some 30%) over conventional double-acting cylinders driven by four way valves
4. Significant increased cylinder/finger impact force as compared to conventionally arranged double-acting cylinders, where rapid response and short cycle times are required (up to 30% estimated).
5. Significant impact force adjustment through the ability to adjust the pressure on the return side of the cylinder, independent of the outward pressure. This allows the finger impact force to be increased or reduced as required.
6. Significant improvement in reject consistency across the full reject bank, by way of common return stroke manifold.
7. Significant improvement in controlling direction of rejected objects of common size into target reject area.
8. Novel cylinder design by way of double seal and a quick exhaust.
9. Significantly reduced pulse to valve to actuate cylinder (50% or less), resulting in lower power consumption.

Various embodiments of the invention will now be described having regard to the following drawings.

DETAILED DESCRIPTION OF THE DRAWINGS

Figure 1:
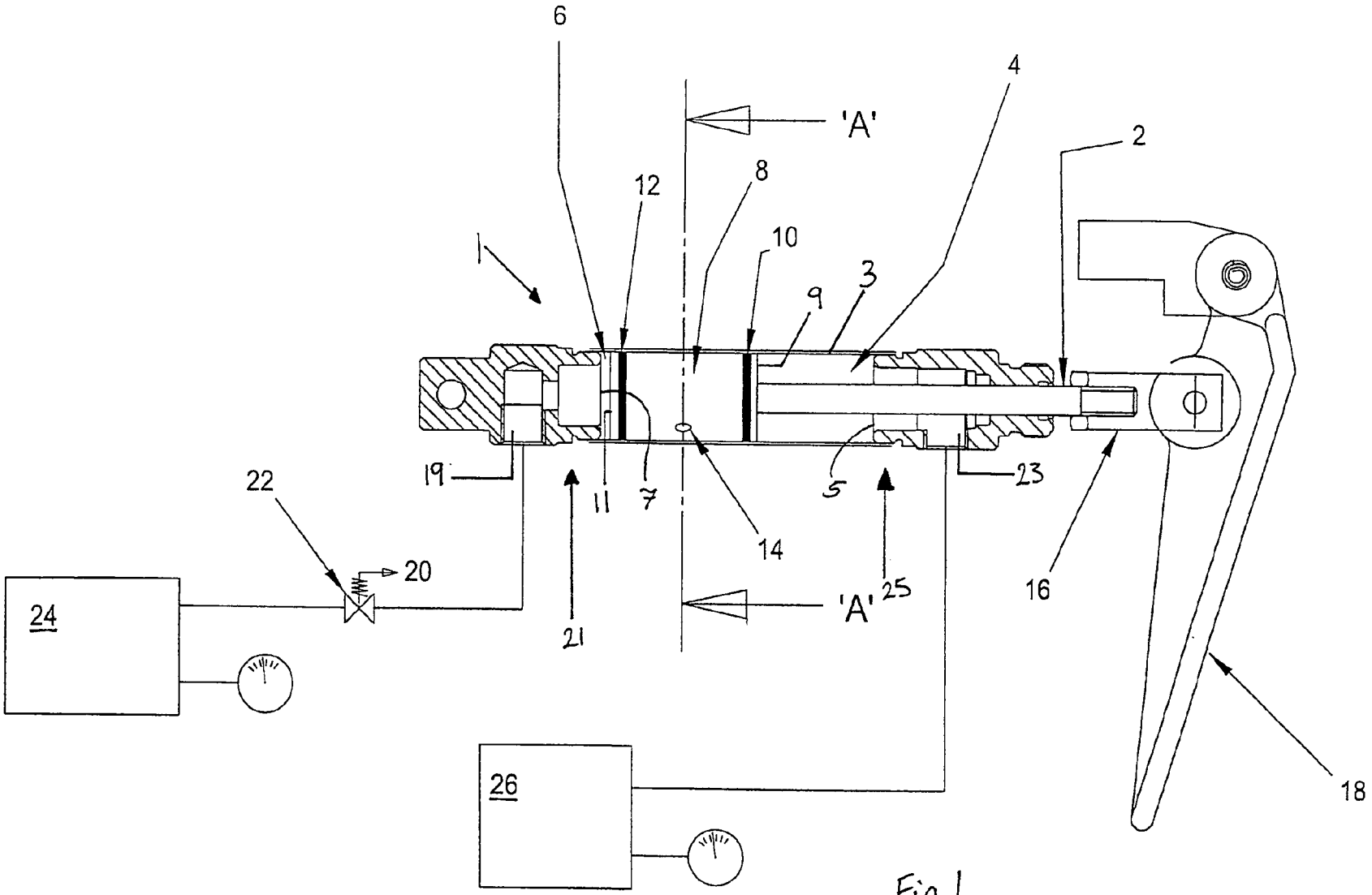
FIG. 1 is an air spring pneumatic system according to the present invention with the cylinder piston rod retracted.

An air spring ejector of the present invention is shown in FIG. 1. The ejector comprises an ejector device or finger 18 activated by a pneumatic cylinder and piston arrangement.

The pneumatic system comprises a double-acting air spring (pneumatic) cylinder 1 within which a piston 8 moves. The cylinder 1 is of uniform diameter throughout its length and the piston 8 is likewise of uniform or constant external diameter over substantially its entire axial length. A piston rod 2 extends from one side or end of the piston to connect in a pivotally driving manner with the finger device 18 at a location external of the cylinder 1. The piston rod passes in a sealing manner through an axial end region of the cylinder 1. The unit 1/8 does not contain any internal springs or other drive elements and is actuated entirely by air pressure for both directions of movement.

A high pressure manifold 24 is connected to a first cylinder port 19 at the rear end 21 of the cylinder 1 via a high speed valve 22. The high speed valve 22 may be for example a 3/2 or 5/2 electro-pneumatic valve. The pressure through the high pressure manifold 24 may be preset at a desired pressure suitably between 20 and 80 PSIG.

A low pressure manifold 26 is connected to a second cylinder port 23 at the leading end 25 of the cylinder 1. A suitable pressure through the low pressure manifold 26 may be in the range from 10 to 30 PSIG.

The unit operates on the basis of the continuous application of a static pressure from the low pressure manifold to one side of the double-acting cylinder piston 8 (the leading side 9) and actuating the cylinder 1 by high speed sorter triggered application of higher pressure (e.g. >10 PSIG more than the low or static pressure applied to the leading face 9 of piston 8) to the other side of the piston 8 (the rear side or face 11).

The low (static) pressure is established by the maintenance of a substantially constant pressure in the manifold 26. The air volume capacity of an individual actuator unit 1/8 as a whole is limited, and the pressure within the manifold 26 is not significantly affected by the movement of the piston 8 within the cylinder 1. Thus the constant pressure manifold 26 does not function to any significant degree as any kind of pressure accumulator or recuperator. Advantages of the present invention are therefore not primarily directed to achieving economies in air usage by way of the reverse static air pressure arrangement as such, but rather to enabling higher speeds of operation of the rejector system, as well as an excellent level of repeatability between successive actuations. The invention is thus directed to actuation units of relatively small dimensions, whose performance parameters outweigh economic issues. Nonetheless, reduced pulsing gives rises to worthwhile economies in energy usage, which is a welcome additional bonus to the operating advantages already achieved by the system of the invention.

Selective use of appropriate air pressures and actuation timing can permit in excess of 2000 ejections per minute. Repeatability is excellent with time differences between multiple ejectors being 0.5 ms or less.

A vent hole 14 is provided on the barrel or cylinder wall 3 of the double-acting cylinder 1. FIG. 1 shows first chamber 6 and second chamber 4 which represent the spaces in the cylinder to the rear and front of the cylinder piston 8 respectively. The vent hole 14 is located in the cylinder barrel 3 at a distance from the rear end wall 7 of the cylinder. The vent hole 14 acts as a quick exhaust port for the first chamber 6. Actuation of cylinder exhaust is thus enabled fully and exclusively by relative sliding movement of the piston 8 with respect to the cylinder wall 1, past the vent hole 14. The venting is thus self-actuating actuating and is not effected by any kind of external arrangement or control system. An especially advantageous and simple structure of actuator unit is thus achieved, in which additional mechanical and electrical control elements are substantially minimised or eliminated.

The rejector or paddle or finger 18 is pivotally mounted at the end of the piston rod 2, external of the cylinder 1. The paddle is pivotally connected to a clevis 16, which in turn is mounted at the free end of the piston rod, this end passing through the front end wall 5 of the cylinder 1 in a sealing manner.

Figure 2:
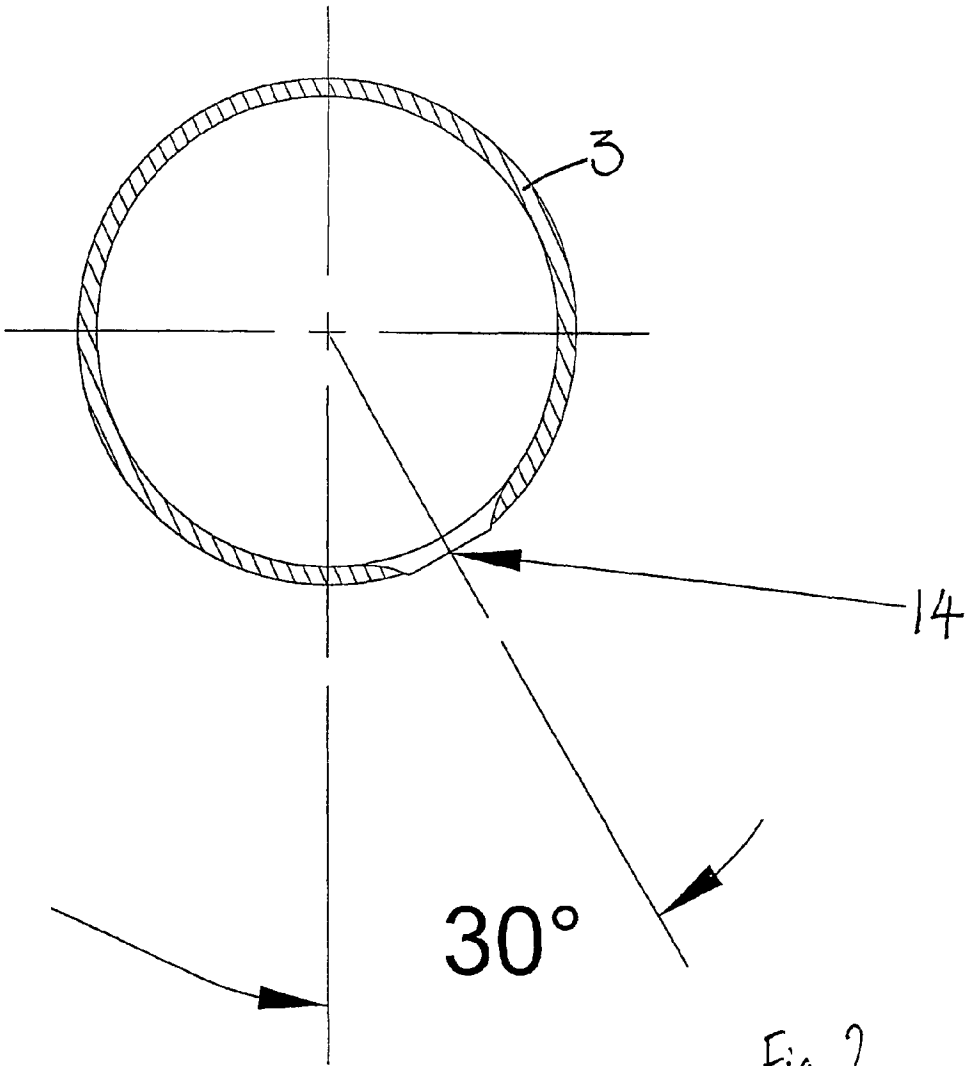
FIG. 2 is a cross sectional view of the cylinder of FIG. 1 taken along the line A-A in FIG. 1, showing the orientation of the exhaust vent hole.

FIG. 2 is a cross-section of the cylinder 1 taken along line A-A in FIG. 1. As shown in FIG. 2, the vent hole 14 at this distance along the barrel 3 can be positioned at an angle from 0 to 180 deg from the upward vertical direction (i.e. the "12 o'clock" position). The angle of 150 deg is preferred to allow a small portion of oil to remain in the first chamber to enhance cylinder lubrication. The venting may be achieved by a single hole or multiple annularly-orientated holes depending on the bore and stroke of the cylinder.

Incorporated into the cylinder piston 8 is a novel double annular seal arrangement comprising a front piston ring 10 and a rear piston ring 12. The front piston ring 10 is used to permanently seal the second (leading) chamber 4 (exposed to static pressure) and thus maintain this side of the cylinder 1 at the prescribed low pressure. The rear piston ring 12 is used to seal the first chamber and maintain this side of the cylinder 1 at the high pressure until the cylinder (piston) rod 2 reaches substantially 50% of full extension. At this position the rear piston ring 12 passes over the vent hole 14, substantially instantly reducing the pressure in the first chamber 6. However, the momentum generated up to this stage carries the cylinder rod 2/ejector 18 to full extension at high velocity, thereby completing actuation of the finger.

All movements thus take place over substantially a full actuating length of the cylinder 1, which is, in a favoured construction of the invention, effectively the full physical axial length of the cylinder 1. In a variant of the invention, the piston stroke may be regulated by appropriate control of operating pressures within the cylinder such that an alternative operating length is established, which is less that the full physical axial length of the unit. One or other of two piston strokes may then be selected, a first piston travel distance equating to full axial displacement of the piston 8 within the cylinder 1, with the other stroke length being a curtailed movement, This selective arrangement enables alternative rejector paths to be adopted or chosen, as already previously adverted to.

Normally in a double-acting cylinder system, venting of the kind described above occurs back through the piping and valve system. This tends to produce a substantial time lag and thus longer cycle times. By addressing this time lag problem by means of the provision of larger valves and piping, other problems regarding repeatability and response time then become issues. With the above-mentioned feature of the quick direct venting to ambient at approximately 50% from the end of the stroke, ambient pressure is achieved within chamber 6 substantially instantaneously, thus eliminating time lag and reducing cycle times. Repeatability is also improved.

Figure 3:
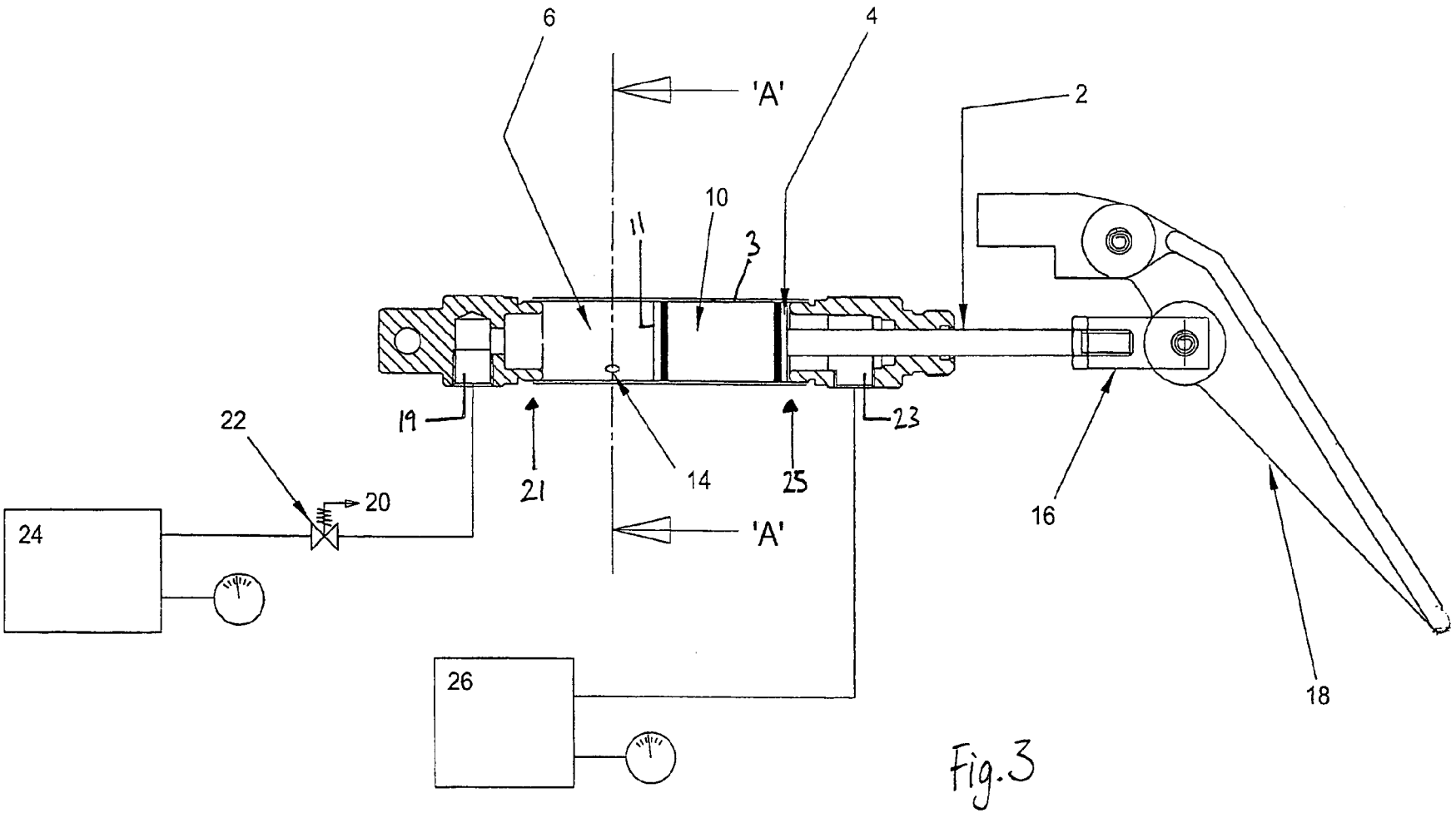
FIG. 3 is the air spring pneumatic system of FIG. 1 with the cylinder piston rod extended.

FIG. 3 shows the air spring pneumatic system of FIG. 1 with the cylinder extended.

Use of the pneumatic rejector system of the present invention during an air spring cylinder cycle will now be described with reference to FIGS. 1 and 3.

Rest Position

The cylinder rod 2 and ejector 18 are fully retracted (as per FIG. 1). The second chamber 4 is at low pressure (10-30 PSIG), thus providing the retracting force to hold finger 18 in its non-operative position, and the first chamber 6 is at ambient pressure.

Cylinder Outstroke (Activation)

A signal is to eject given by a detection device. This is converted to an excitation of a high speed valve coil in the high speed valve 22 which in turns opens the valve, simultaneously closing the valve's exhaust port 20. Typical excitation times are 4 to 30 ms. During excitation, air is allowed to pass from the high pressure manifold 24 to first chamber 6. As this pressure is 10 PSI or more higher than that in the second chamber 4, the cylinder rod/ejector 18 immediately begins to outstroke. The second chamber 4 pressure is held static, so that as the pressure in the first chamber 6 increases, the cylinder rod/ejector 18 acceleration increases, such that a substantially steady velocity is reached at less than 10% of stroke.

Cylinder at Full Extension (as per FIG. 3)

As the cylinder rod/ejector 18 nears substantially 50% of full extension, the rearward (rear) piston ring 12 passes over the vent hole 14 in the cylinder barrel 3. This has the effect of rapidly depressurising the first chamber 6 which notionally permits the cylinder rod/ejector 18 to begin to decelerate. However, the momentum already imparted to the cylinder rod/ejector 18 is such that it continues to the end of its stroke with a velocity substantially equal to that when it commenced venting. Very high speed outstroke times down to 5 ms (half of current conventional times) are achieved. Even though the cylinder is travelling at high velocity toward full stroke, the second chamber 4 is still at low pressure (i.e. the static pressure of 10-30 PSI) and so acts as an air cushion for the piston 8. This dramatically reduces shock on the cylinder unit and ejector mechanism, thereby improving ejector lifetimes.

Cylinder Retraction (Deactivation)

On most efficient ejection systems, the excitation time will have expired before the cylinder reaches full stroke. This is still the case with the present air spring arrangement. When the high speed valve excitation time expires, the connection between the high pressure manifold and the first cylinder port 19 is closed off, with simultaneous opening of the valve's exhaust port 20. The first chamber 6 is now depressurised to ambient pressure, initially via both vent 14 and the valve exhaust 20, and, after piston seal 12 passes over vent 14, via exhaust 20 only, so that the static low pressure (10-30 PSIG) of the second chamber 4 now immediately forces the cylinder rod/ejector 18 to retract.

For the first 50% approximately of the return stroke, the free air in the first chamber 6 is expelled to ambient through the vent hole 14, permitting the full pressure differential between the static pressure and ambient to prevail or be effective, resulting in high speed retraction. For the last 50% approximately of the return stroke, the rear seal (piston ring 12) now passes back over the vent hole 14 and thus reseals the first chamber 6. All remaining air trapped in the first chamber 6 is now forced back through the piping and high speed valve exhaust port 20. This air is however already at ambient pressure and so represents substantially less volume than a conventional system requires to expel through a valve exhaust port. Retraction continues therefore at higher speed. Coupled to this is the fact that by virtue of the slight throttling effect of the line between port 19 and vale 22 and possibly also at port 20 itself (which would be disadvantageous in the absence of the vent 14 provided by the present invention), at near full retraction a low level of pressure (1-3 PSIG) has again built up in the first chamber 6, thus creating a small air cushioning effect. This again reduces shock on the cylinder components and the ejector mechanics, thereby again prolonging the life of the units.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A double-acting cylinder and piston mechanism comprising:

a cylinder (1) substantially closed at both ends by front (5) and rear (7) end walls, a piston (8) axially displaceable within the cylinder (1), a first region (6) defined between the piston (8) and the rear end wall (7) of the cylinder (1) and a second region (4) defined between the piston (8) and the front end wall (5) of the cylinder (1), a piston rod (2) extending from the piston (8) through the front end wall (5) of the cylinder (1), an air inlet port (19) for communication with said first region (6) of the cylinder (1), and at least one exhaust vent (14) which is exposed during axial displacement of the piston (8) for release of air delivered to the first region (6) of the cylinder (1) through the air inlet port (19), wherein the piston (8) is of sufficient length to prevent communication between the second region (4) and the exhaust vent (14) so that a static air pressure may be maintained in the second region (4) of the cylinder (1) to cushion impact between the piston (8) and the front end wall (5) of the cylinder (1).

2. A double-acting cylinder and piston mechanism according to claim 1, wherein an axial displacement of the piston (8) is effected by a change in the differential pressure between the air in the first region (6) and the air in the second region (4) of the cylinder (1).

3. A double-acting cylinder and piston mechanism according to claim 1, wherein the exhaust vent (14) is defined in the cylinder wall (3).

4. A double-acting cylinder and piston mechanism according to claim 3, wherein, in a horizontal disposition of the cylinder (1), the exhaust vent (14) is located at a circumferential angular location relative to the lowermost longitudinal extent of the cylinder (1).

5. A double-acting cylinder and piston mechanism according to claim 1, wherein the air inlet port (19) is at a first axial end region of the cylinder (1).

6. A double-acting cylinder and piston mechanism according to claim 1, further comprising sealing means (10, 12) between the piston (8) and the cylinder wall (3).

7. A double-acting cylinder and piston mechanism according to claim 6, wherein the sealing means (10, 12) comprises at least one piston ring (10, 12).

8. A pneumatic product rejection system comprising a double-acting cylinder and piston mechanism including:

a cylinder (1) substantially closed at both ends by front (5) and rear (7) end walls, a piston (8) axially displaceable within the cylinder (1), a first region (6) defined between the piston (8) and the rear end wall (7) of the cylinder (1) and a second region (4) defined between the piston (8) and the front end wall (5) of the cylinder (1), a piston rod (2) extending from the piston (8) through the front end wall (5) of the cylinder (1), an air inlet port (19) for communication with said first region (6) of the cylinder (1), and at least one exhaust vent (14) which is exposed during axial displacement of the piston (8) for release of air delivered to the first region (6) of the cylinder (1) through the air inlet port (19), wherein the piston (8) is of sufficient length to prevent communication between the second region (4) and the exhaust vent (14) so that a static air pressure may be maintained in the second region (4) of the cylinder (1) to cushion impact between the piston (8) and the front end wall (5) of the cylinder (1).

9. A pneumatic product rejection system according to claim 8 further comprising:

a high pressure manifold (24) in communication with the air inlet port (19), a low pressure manifold (26) in communication with the second region (4) in the cylinder a control valve (22) between the high pressure manifold (24) and the air inlet port (19), and a paddle (18) mounted at the free end of the piston rod (2) for contacting and displacing from its path a product to be rejected.

10. A pneumatic product rejection system according to claim 9 wherein the paddle (18) is pivotally mounted at the free end of the piston rod (2).

11. A pneumatic product rejection system according to claim 9 comprising a multiplicity of paddles (18).

12. A pneumatic product rejection system according to claim 8 further comprising:

a paddle (18) mounted for displacement between a first product rejecting position and a clear position for the uninhibited passage of product;

means for displacing the paddle (18) from the clear position towards the first rejecting position; and means for selectively curtailing drive movement of the displacing means on completion of a predetermined increment of travel, less than the travel required to displace the paddle (18) from the clear position to the first rejecting position.

13. A pneumatic product rejection system according to claim 12 comprising a double-acting cylinder and piston mechanism and said means for selectively curtailing drive movement of the displacing means is adapted to control air pressure forward of the piston (8) in the direction of advance of the piston (8) in order to achieve at least one alternative product rejecting position of the paddle (18) located between the first product rejecting and clear positions of the paddle (18).

14. A pneumatic product rejection system according to claim 12 comprising a multiplicity of paddles (18).

* * * * *